US005979049A

United States Patent [19]

Evans et al.

[11] Patent Number: 5,979,049

[45] Date of Patent: Nov. 9, 1999

[54] AUTOMOTIVE SPARK PLUG COVER

[75] Inventors: Chris Howard Evans, Dumas; Fredric Jay Anderson, Monticello; Gary Eugene Brown, Dumas; Rodney Lud Bevill, Monticello; James Thomas Ducote, Dumas; James Richard Giannone, Monticello, all of Ark.

[73] Assignee: Federal-Mogul World Wide Inc., Southfield, Mich.

[21] Appl. No.: 09/133,809

[22] Filed: Aug. 13, 1998

Related U.S. Application Data

[62] Division of application No. 08/611,519, Mar. 6, 1996, Pat. No. 5,813,872.

[51] Int. Cl.[6] ..... H01R 19/00

[52] U.S. Cl. ..... 29/887; 156/89; 439/125

[58] Field of Search ..... 29/887; 439/125; 156/89

[56] References Cited

U.S. PATENT DOCUMENTS

| | | | |
|---|---|---|---|
| 2,904,769 | 9/1959 | Sampson et al. | 439/125 |
| 4,810,198 | 3/1989 | Sturdevan | 439/125 |
| 5,053,092 | 10/1991 | Lachman | 156/89 |
| 5,274,298 | 12/1993 | Cassidy et al. | 123/169 CL |
| 5,297,971 | 3/1994 | Nitta et al. | 439/125 |

*Primary Examiner*—Carl J. Arbes
*Attorney, Agent, or Firm*—Fish & Richardson P.C.

[57] ABSTRACT

A spark plug cover includes a silicone elastomeric boot that includes a first portion for covering a spark plug terminal area and a second portion including a corrugated portion for covering a lead wire. A seal is provided at each end of the corrugated region. A ceramic shield covers a part of the elastomeric boot adjacent the spark plug terminal area. A recessed portion in the silicone elastomeric boot retains the ceramic shield, and a chamfered surface provided on the silicone elastomeric boot facilitates mounting the silicone elastomeric boot within the ceramic shield.

5 Claims, 3 Drawing Sheets

AUTOMOTIVE SPARK PLUG COVER

This application is a divisional of Ser. No. 08/611,579 filed Mar. 6, 1996 U.S. Pat. No. 5,813,872.

BACKGROUND OF THE INVENTION

1. Field of the Invention

The present invention relates to a spark plug cover, and more particularly, to a spark plug cover intended to withstand elevated temperatures.

2. Discussion of Related Art

Some automobiles, particularly heavy duty trucks, lightweight trucks, and utility vehicles, operate generally at lower ground speeds with higher engine rpm's because of pulling heavy loads or climbing steep grades. As a result, the engines of such vehicles tend to have higher heat at the exhaust manifold and spark plug locations. The higher heat tends to destroy the spark plug cover at the ignition lead.

Furthermore, as engine compartments are made progressively smaller, and the flow of air around the engine decreases, the heat buildup within the engine compartment continues to increase.

As the spark plug cover deteriorates, the insulating properties of the spark plug cover also deteriorate. Upon deterioration of the cover material, the voltage applied to the spark plug is no longer able to be contained within the ignition wire, or cover. As a result, the voltage will follow the path of least resistance to ground. When the unconfined voltage does not pass through the spark plug, the engine will misfire on that cylinder, resulting in decreased engine performance.

SUMMARY

An objection of the present invention is to provide thermal protection for the ignition conductor in the area of the spark plug connection.

Another objection of the present invention is to provide thermal protection for the ignition conductor immediately above the location where other spark plug covers discontinue thermal protection.

A still further objection of the present invention is to provide a means of allowing the ignition conductor to exit the spark plug cover at any angle and continue to have the thermal protection of the silicone material. According to one embodiment of the invention, the spark plug cover includes an elastomeric boot, said boot including a first portion for covering a spark plug terminal area and a second portion for covering a lead wire; and a ceramic shield covering a part of said elastomeric boot.

A method of making a spark plug cover according to one embodiment of the invention includes the steps of retaining a tubular ceramic shield in a rigid fixture; pulling an elastomeric boot through the ceramic shield until a shoulder on an outer surface of the boot engages with an end of the tubular ceramic shield; and releasing the tubular ceramic shield from the rigid fixture.

DETAILED DESCRIPTION OF THE PREFERRED EMBODIMENTS

Figure 1:
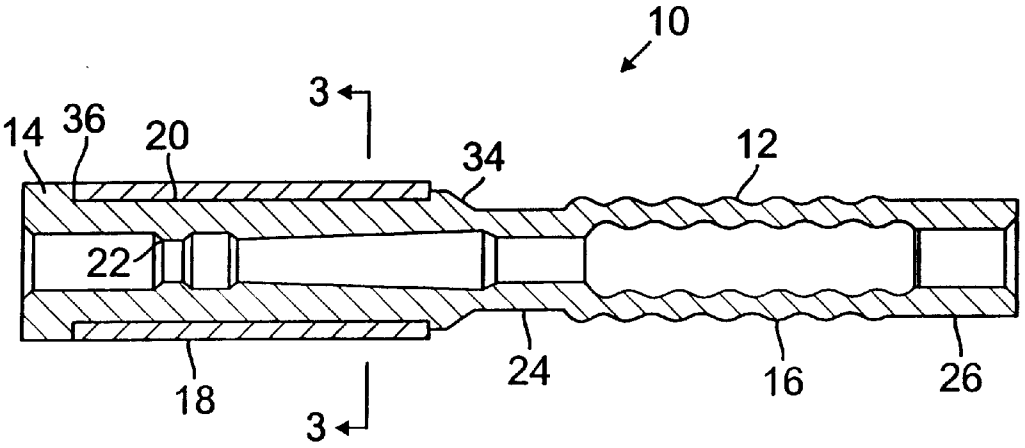
FIG. 1 is a cross-sectional view of a spark plug cover according to the present invention.
Figure 2:
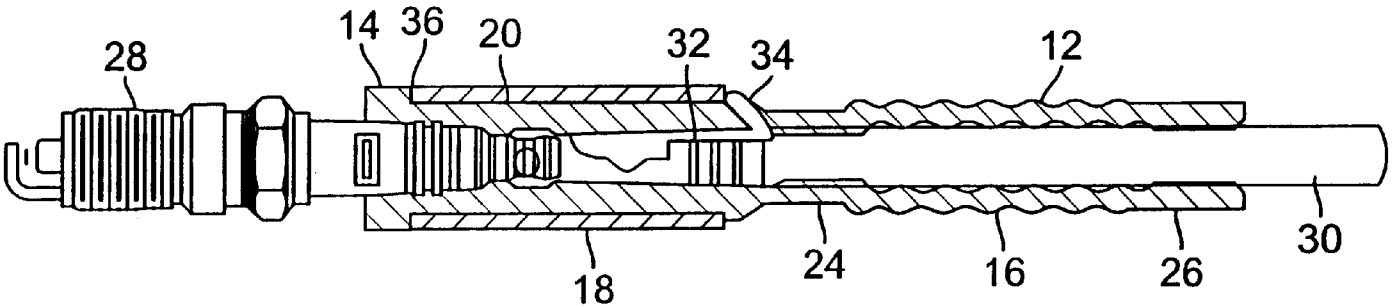
FIG. 2 is a cross-sectional view of the spark plug cover of FIG. 1 positioned on a spark plug.
Figure 3:
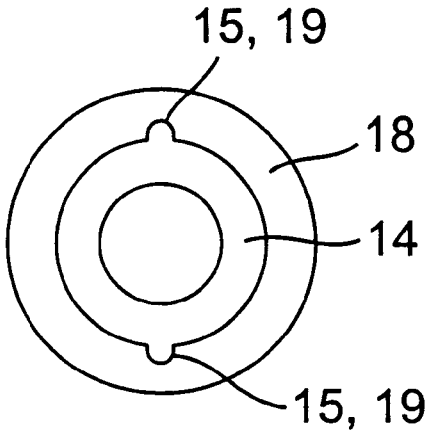
FIG. 3 is a cross-sectional view taken along line III—III of FIG. 1.

Turning attention to FIGS. 1–3, a spark plug cover 10 is illustrated.

The spark plug cover 10 includes a silicone elastomeric boot 12. The boot 12 includes a first portion 14 for covering the terminal area of a spark plug, and a second portion 16 for covering a lead wire 30 that is intended to be connected to the spark plug terminal.

Although many different types of elastomeric materials may be used for the elastomeric boot, the elastomeric boot 12 is preferably made out of a silicone material that is able to withstand temperatures of up to 650° F.

The second portion 16 of the elastomeric boot 12 may be provided with a corrugated, or accordion-like surface in order to promote flexibility of the boot. By having a flexible portion in the boot 12, the lead wire 30 to the spark plug may be easily positioned wherever desired.

In order to prevent moisture from entering the boot, a moisture tight seal 24, 26 is provided at each end of the second corrugated portion 16. The seals 24, 26 prevent moisture, or other debris, from entering the spark plug terminal area, and thus reduce the potential for corrosion of the terminal. The seals 24, 26 also serve as dielectric insulators by containing the ignition system voltage within the silicone boot.

The corrugated design of the boot 12 also increases the effective radius or thickness of the boot 12, thus increasing the distance that voltage must travel to the outer surface of the elastomeric boot 12.

To provide additional thermal protection for the spark plug cover 10, a ceramic shield 18 is provided around a portion of the elastomeric boot 12. The ceramic shield 18 is preferably composed of Zirconia enhanced ceramic insulator which has been temperature tested to 1,750° F. without failure. However, other insulating materials may be used.

When the ceramic sleeve 18 was tested at 1,750° F. with a heat source applied to the exterior of the sleeve 18, measurements of 425° F. or less were observed on the outer surface of the elastomeric boot 12. In a preferred embodiment, the ceramic sleeve 18 extends over the elastomeric boot 12 to a distance that is at least 1½ inches above the spark plug terminal area.

A recessed area 20 may be provided in the elastomeric boot 12 for retaining the ceramic shield 18. In addition, a chamfered edge 34 may be provided on the elastomeric boot 12 in order to facilitate placing the elastomeric boot 12 within the ceramic shield 18.

As can be seen in FIG. 3, the internal surface of the ceramic shield 18 includes a pair of longitudinally extending grooves 19 that preferably run the entire length of the ceramic shield 18. The grooves 19 engage with compatible longitudinally extending ridges 15 that are formed on the first portion 14 of the elastomeric boot 12. The ridges 15 and grooves 19 are intended to secure the shield 18 on the boot 12 without rotation. Alternatively, only one ridge and groove may be used, instead of two.

In a preferred embodiment, the ceramic shield 18 is 1.75 inches in length and has an outer diameter of about 0.9 inches. The thickness of the shield 18 is about 0.125 inches.

In order to assemble the spark plug cover 10 of the present invention, the ceramic shield 18 may be retained in a rigid fixture. The elastomeric boot 12 is then pulled through the ceramic shield 18 until a shoulder 36 of the elastomeric boot 12 contacts an end of the ceramic shield 18. The chamfered edge 34 facilitates placing the elastomeric boot 12 within the ceramic shield 18.

Within the elastomeric boot 12, various ridges and recesses 22 may be formed in order to accommodate a spark plug 28.

Turning attention now to FIG. 2, the spark plug cover 10 of the present invention is illustrated with a spark plug 28 mounted therein. The terminal lead 30 extends through the accordion-like region 16 of the elastomeric boot 12. A clip 32 connects the terminal wire 30 to the spark plug 28.

Figure 4:
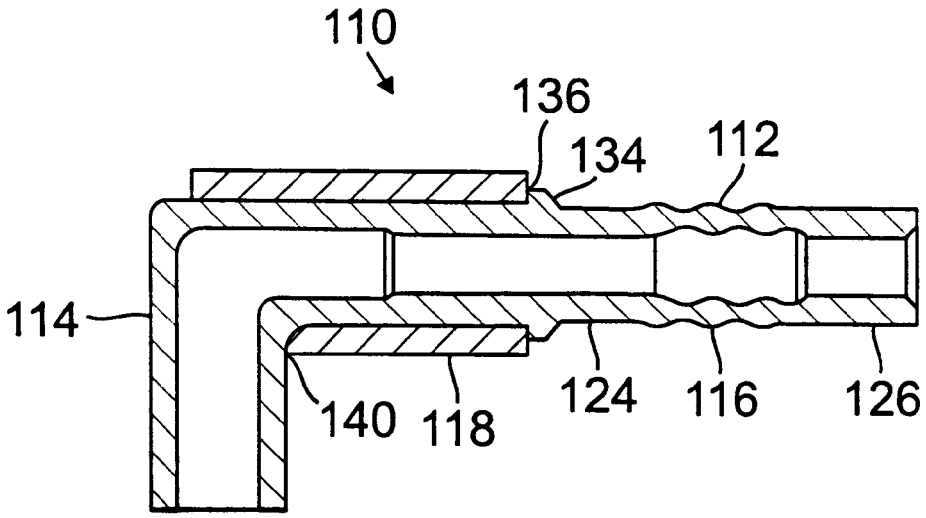
FIG. 4 is a cross-sectional view of another spark plug cover according to the present invention.
Figure 5:
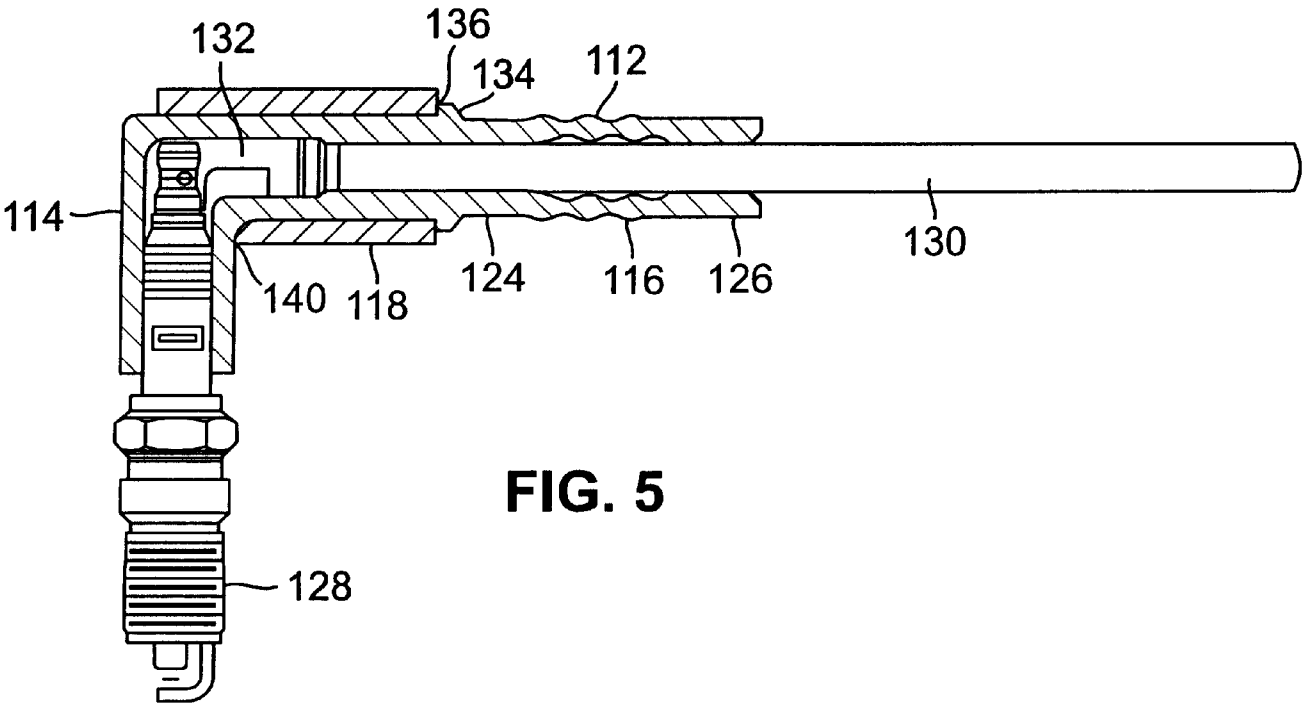
FIG. 5 is a cross-sectional view of the spark plug cover of FIG. 4 positioned on a spark plug.
Figure 6:
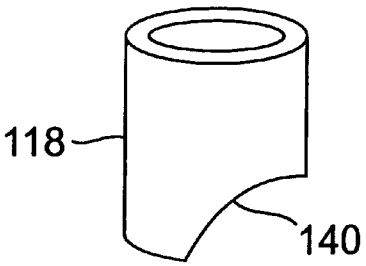
FIG. 6 is a perspective view of a shield used on the spark plug cover of FIG. 4.

Turning attention now to FIGS. 4–6, a second embodiment of the present invention is illustrated. The second embodiment is similar to the first embodiment, except that the second embodiment includes a 90° bend in the elastomeric boot. The spark plug cover 110 includes an elastomeric boot 112 that has a first portion 114 for covering the spark plug terminal area and a second portion 116 for covering the lead wire 130.

The second portion 116 of the elastomeric boot 112 includes a corrugated region to include flexibility. The second portion 116 further includes seals 124, 126 at each end of the corrugated region to keep moisture and debris from reaching the spark plug terminal area.

The spark plug cover 110 includes a shoulder 136 on the elastomeric boot 112 in order to retain an end of the ceramic shield 118. The ceramic shield 118 includes a notched portion 140 to accommodate the bend in the elastomeric boot 112.

The elastomeric boot 112 also includes a chamfered edge 134 to facilitate inserting the elastomeric boot 112 into the ceramic shield 118.

The lead wire 130 includes a terminal clip 132 that connects to the spark plug 128 in the first portion 114 of the elastomeric boot 112.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A method of making a spark plug cover, the method comprising:

retaining a tubular insulating shield in a rigid fixture;

pulling an elastomeric boot through the insulating shield until a shoulder on an outer surface of the elastomeric boot engages with an end of the tubular insulating shield; and releasing the tubular insulating shield from the rigid fixture.

2. The method of claim 1, further comprising guiding the elastomeric boot through the insulating shield by means of a chamfered edge on an outer surface of the elastomeric boot.

3. The method of claim 1, wherein pulling the elastomeric boot through the insulating shield comprises pulling the boot through the shield until a portion of the boot extends from an end of the shield opposite the end at which the shoulder of the elastomeric boot engages the shield.

4. The method of claim 1, wherein the portion of the boot is sized to receive a lead wire.

5. The method of claim 1, where the shield comprises a ceramic shield.

* * * * *